US009237813B2

(12) United States Patent
Dubois

(10) Patent No.: US 9,237,813 B2
(45) Date of Patent: Jan. 19, 2016

(54) ADJUSTABLE HEIGHT AID FOR STRETCHING A SHEET

(71) Applicant: Fixacouette SAS, Neuilly sur Seine (FR)

(72) Inventor: Philippe Dubois, Paris (FR)

(73) Assignee: Fixacouette SAS, Neuilly sur Seine (FR)

( * ) Notice: Subject to any disclaimer, the term of this patent is extended or adjusted under 35 U.S.C. 154(b) by 0 days.

(21) Appl. No.: 14/312,744

(22) Filed: Jun. 24, 2014

(65) Prior Publication Data

US 2015/0366364 A1 Dec. 24, 2015

(51) Int. Cl.

| | |
|---|---|
| ***A47C 31/00*** | (2006.01) |
| ***A47C 21/02*** | (2006.01) |
| *A47C 31/02* | (2006.01) |

(52) U.S. Cl.

CPC ..... *A47C 21/028* (2013.01); *A47C 21/02* (2013.01); *A47C 21/022* (2013.01); *A47C 31/02* (2013.01)

(58) Field of Classification Search

CPC ..... A61G 2007/0508; A61G 2007/0519; A47C 21/02; A47C 21/022; A47C 21/028; A47C 31/02; A47C 31/023

USPC ..... 5/495, 496, 504.1, 428–430, 486, 662, 5/501, 502

See application file for complete search history.

(56) References Cited

U.S. PATENT DOCUMENTS

| | | | | | |
|---|---|---|---|---|---|
| 672,881 | A | * | 4/1901 | Allen | 24/72.5 |
| 807,706 | A | * | 12/1905 | Allen | 24/72.5 |
| 1,513,009 | A | * | 10/1924 | Robb | 24/564 |
| 1,582,653 | A | * | 4/1926 | Alleyne | 5/649 |
| 2,423,222 | A | * | 7/1947 | Berry | 174/40 CC |
| 2,560,494 | A | * | 7/1951 | Tarvin | 5/504.1 |
| 2,979,736 | A | * | 4/1961 | Kemman | 5/504.1 |
| 3,092,848 | A | * | 6/1963 | Gronvold | 5/495 |
| 3,981,534 | A | * | 9/1976 | Wilton | 297/218.1 |
| 4,234,035 | A | * | 11/1980 | Babbs | 160/392 |
| 4,858,285 | A | * | 8/1989 | Dala et al. | 24/555 |
| 5,016,306 | A | * | 5/1991 | Grivna et al. | 5/498 |
| 5,035,464 | A | * | 7/1991 | Spallholtz | 297/144 |

(Continued)

FOREIGN PATENT DOCUMENTS

| | | |
|---|---|---|
| EP | 2186442 | 5/2010 |
| GB | 2247169 | 2/1992 |
| WO | 2012/084554 | 6/2012 |

OTHER PUBLICATIONS jalopnik.com Feb. 27, 2013.*

*Primary Examiner* — David E Sosnowski
*Assistant Examiner* — Morgan McClure
(74) *Attorney, Agent, or Firm* — Stradley Ronon Stevens & Young, LLP

(57) ABSTRACT

An adjustable height device for aiding in the stretching of a sheet. The device may include a bracket for attaching the device to a bottom surface of a bed frame, a first connector attached to the bracket by a first rotating element so that the first connector can rotate about the first rotating element with respect to the bracket, a telescoping shaft attached to the first connector by a second rotating element so that the telescoping shaft is rotatable about the second rotating element with respect to the first connector, and a gripping device attached to the telescoping shaft by a second connector. The telescoping shaft may be made of an inner shaft slidably inserted into an outer shaft. The gripping device may include a base having a first gripping surface and a movable element having a second gripping surface rotatable about a rotational axis with respect to the base.

20 Claims, 9 Drawing Sheets

(56) References Cited

U.S. PATENT DOCUMENTS

| | | | | |
|---|---|---|---|---|
| 5,329,658 | A * | 7/1994 | Fontenot et al. | 5/505.1 |
| 5,362,021 | A * | 11/1994 | Phillips | 248/276.1 |
| 5,394,579 | A * | 3/1995 | Walters | 5/504.1 |
| 5,400,478 | A * | 3/1995 | Levinsohn et al. | 24/72.5 |
| 5,404,602 | A * | 4/1995 | Kondo | 5/504.1 |
| 5,592,153 | A * | 1/1997 | Welling et al. | 248/278.1 |
| 5,926,874 | A * | 7/1999 | Browder | 5/488 |
| 6,363,555 | B1 * | 4/2002 | LaRose | 5/600 |
| 6,485,103 | B1 * | 11/2002 | Yamada et al. | 297/452.56 |
| 6,486,792 | B1 * | 11/2002 | Moster et al. | 340/4.11 |
| 6,490,768 | B1 * | 12/2002 | Goodall | 24/334 |
| 6,836,913 | B2 * | 1/2005 | Perrin et al. | 5/498 |
| 6,877,175 | B1 * | 4/2005 | Jeffries et al. | 5/504.1 |
| 7,152,260 | B2 * | 12/2006 | Ota | 5/504.1 |
| 7,805,789 | B1 * | 10/2010 | Dean | 5/662 |
| 7,865,984 | B2 * | 1/2011 | Merritt | 5/503.1 |
| 7,870,622 | B2 * | 1/2011 | Nygren et al. | 5/426 |
| 8,443,472 | B2 * | 5/2013 | Sherman et al. | 5/503.1 |
| 8,590,080 | B1 * | 11/2013 | Staresinic | 5/658 |
| 8,621,692 | B1 * | 1/2014 | Kring | 5/658 |
| 8,745,787 | B1 * | 6/2014 | Heimlich | 5/498 |
| 2003/0024047 | A1 * | 2/2003 | Wu | 5/430 |
| 2004/0060113 | A1 * | 4/2004 | Lantagne | 5/494 |
| 2006/0162077 | A1 * | 7/2006 | McDaniel et al. | 5/611 |
| 2006/0174408 | A1 * | 8/2006 | Flannery | 5/426 |
| 2009/0049616 | A1 * | 2/2009 | Maschke | 5/658 |
| 2010/0115701 | A1 * | 5/2010 | Norton | 5/498 |
| 2010/0242176 | A1 * | 9/2010 | Newkirk et al. | 5/602 |
| 2014/0068900 | A1 * | 3/2014 | Lovasz et al. | 24/543 |
| 2015/0026885 | A1 * | 1/2015 | Christensen | 5/488 |
| 2015/0047158 | A1 * | 2/2015 | Toribuchi et al. | 24/700 |

* cited by examiner

ADJUSTABLE HEIGHT AID FOR STRETCHING A SHEET

TECHNICAL FIELD

The present invention relates generally to an aid for covering a comforter with a duvet cover and for stretching a sheet, particularly to an aid mounted to the underside of a bed frame having an adjustable height.

BACKGROUND OF THE INVENTION

Musculoskeletal disorders, back and joint pain, and poor spinal posture are known occupational hazards for housekeepers in the hospitality industry. Hotel workers are nearly 40% more likely to be injured on the job than other service-sector employees, and housekeepers have the highest overall injury rate of any category of hotel employee. In addition to diminishing staff members' quality of life, these disorders are costly for employers, weighing on productivity and increasing workers compensation costs.

When making a bed, the housekeeper positions the comforter into all four corners of a clean duvet cover and spreads the two evenly over the bed, fluffing them multiple times to eliminate wrinkles and position the duvet symmetrically atop the bed. When unmaking a bed, the housekeeper separates the dirty duvet cover from the comforter by grabbing the corner of the cover and pulling away the heavy duvet. This separation requires great physical exertion from the back, waist, hips, arms, shoulders, wrists, and hands.

Housekeepers constantly stoop, bend, and twist when changing bed linen; time pressure magnifies these risks and causes overexertion. Furthermore, hotels are investing more in upscale, oversized bedding with increasingly heavy and cumbersome duvets (upwards of 15 pounds). Particularly for oversized bedding, two people are often required to stretch a wrinkled sheet or cover a comforter with a duvet cover. A second person is not always available, however, and one person must often accomplish the task alone.

Prior attempts to reduce the strain of applying and removing the duvet cover include the one disclosed in WO 2012/084554 A1, which uses one or a pair of self-locking plastic devices mounted to either side of a bed frame or a box spring towards the head of the bed. Each of the plastic devices has a first gripping surface on a base and a second gripping surface on a moveable element rotatable about a rotational axis with respect to the base. The duvet or sheet is held between the first gripping surface and the second gripping surface when the movable element is rotated toward the base.

As previously mentioned, however, changing consumer trends have led the hotel industry to invest in oversized luxury bedding, including taller box springs, resulting in varying duvet overhang lengths that make the devices disclosed in WO 2012/084554 A1 undesirable or inoperable. If the device is mounted to the bottom of the bed frame, the duvet may not hang down far enough to reach the device. If the device is instead mounted to the box spring to ensure the duvet can reach the device, the device is visible to hotel guests, who may find the device aesthetically displeasing or be tempted to tamper with the device.

SUMMARY OF THE INVENTION

Embodiments of the present invention include adjustable-height devices to aid the stretching of a sheet. The device may include a bracket for attaching the adjustable-height device to a bottom surface of a bed frame, a first connector attached to the bracket by a first rotating element so that the first connector can rotate about the first rotating element with respect to the bracket, a telescoping shaft attached to the first connector by a second rotating element so that the telescoping shaft is rotatable about the second rotating element with respect to the first connector, and a gripping device attached to the telescoping shaft by a second connector. The telescoping shaft may be made of an inner shaft slidably inserted into an outer shaft. The gripping device may include a base having a first gripping surface and a movable element having a second gripping surface. The movable element may be rotatable about a rotational axis with respect to the base and be a rotationally symmetrical cylinder having a center axis offset from the rotational axis.

Embodiments may further include an adjustable-height device including a telescoping shaft having a first end attachable to a bottom surface of a bed frame by a rotatable connector and a gripping device attached to a second end of the telescoping shaft opposite the first end of the telescoping shaft. The adjustable-height device may be maneuvered, by rotating the rotatable connector, into (i) a stored position wherein the telescoping shaft and gripping device are stored entirely beneath the bed frame, (ii) a first use position wherein the telescoping shaft is not beneath the bed frame and is in a substantially vertical and unextended position, and the gripping device is positioned at a first height higher than the bottom surface of the bed frame; and (iii) a plurality of second use positions wherein the telescoping shaft is not beneath the bed frame and is in a substantially vertical and extended position, and the gripping device is positioned at a second height higher than the first height and higher than the bottom surface of the bed frame.

Embodiments may further include a kit having a pair of the adjustable height devices described above.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION

Figure 1:
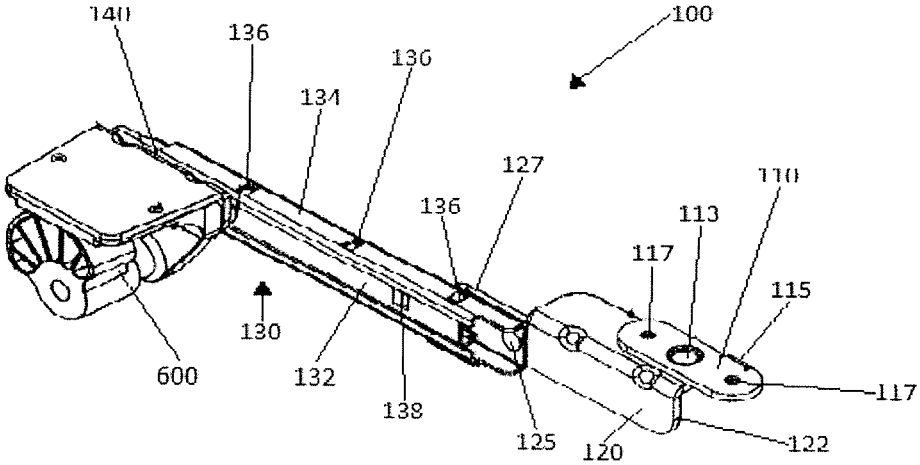
FIG. 1 is a view of a preferred embodiment of the inventive adjustable-height aid for stretching a sheet.

Referring now to the drawing, in which like reference numbers refer to like elements throughout the various figures that comprise the drawing, embodiments of the present invention include devices for aiding in stretching a sheet over a bed. The aid is affixed to the bottom of a bed frame or box spring beneath the bed, and may be rotated out from a stored position beneath the bed and extended to a desired height above the bottom of the bed frame or box spring. For the purposes of this embodiment, a sheet refers to any covering intended to be stretched over a bed, such as a sheet; a comforter; or a duvet, with or without a duvet cover. The aid may most commonly be used to cover a comforter with a duvet cover.

Referring to FIG. 1, an exemplary device 100 includes a bracket 110, a first connector 120, a telescoping shaft 130, a second connector 140, and a gripping device 600. Some or all of the elements of the device 100 may be made of metal, or alternatively a plastic, unless otherwise noted. Other materials are also explicitly contemplated.

The bracket 110 is connected to the first connector 120 by a first rotating element 113, where the first connector 120 may be rotated about the first rotating element 113 with respect to the bracket 110. In a preferred embodiment, the first connector 120 may be a substantially straight piece, as depicted in FIG. 1. In other embodiments, the first connector 120 may be L-shaped, as depicted in FIGS. 2-5B. In some embodiments, the first rotating element 113 may be a rivet. The bracket 110 may also include a stop 115 hanging down from the edge of the bracket 110 opposite the rotation of the first connector 120 to limit the rotation of the first connector 120, for example, by 90 degrees relative to the bracket 110. The stop 115 may be an L-shaped piece attached to the bracket 110, where a first end 122 of the first connector 120 contacts the stop 115 after rotating up to the desired limit. The desired limit of rotation may be 90 degrees or may be any other suitable, predetermined amount. By "predetermined" is meant determined beforehand, so that the predetermined characteristic (e.g., amount of rotation) must be determined, i.e., chosen or at least known, in advance of some event (e.g., manufacture). The bracket 110 may be of varying lengths, for example the shorter bracket depicted in FIG. 1 or the longer bracket depicted in FIGS. 2-5B.

The telescoping shaft 130 includes an inner shaft 132 and an outer shaft 134, where the inner shaft 132 is slidably inserted into the outer shaft 134. The outer shaft 134 is connected to a second end 127 of the first connector 120, opposite the first end 122 of the first connector 120, by a second rotating element 125, where the telescoping shaft 130 may be rotated about the second rotating element 125 with respect to the first connector 120. In some embodiments, the first rotating element 113 may be a rivet. The inner shaft 132 may be extended from the outer shaft 134 to increase the length of the telescoping shaft 130. The inner shaft 132 may be locked in the unextended position or a plurality of extended positions, for example, by one or more spring-loaded pins 136 mounted on the inner shaft 132 and sized to fit within one of a plurality of openings 138 located along the length of the outer shaft 134.

The gripping device 600 is connected to the inner shaft 132 by the second connector 140, so that the gripping device 600 is positioned at the end of the telescoping shaft 130 opposite the first connector 120. In a preferred embodiment, the second connector 140 is a series of fasteners such as rivets irremovably connecting the gripping device 600 to the inner shaft 132. In other embodiments, the second connector 140 may be a shoe sized to fit a foot of the gripping device 600, so that the gripping device 600 may be detached and reattached to the inner shaft 132. The gripping device 600 and the shoe are described in more detail below in conjunction with FIGS. 6A and 6B and FIGS. 7A and 7B.

Figure 2:
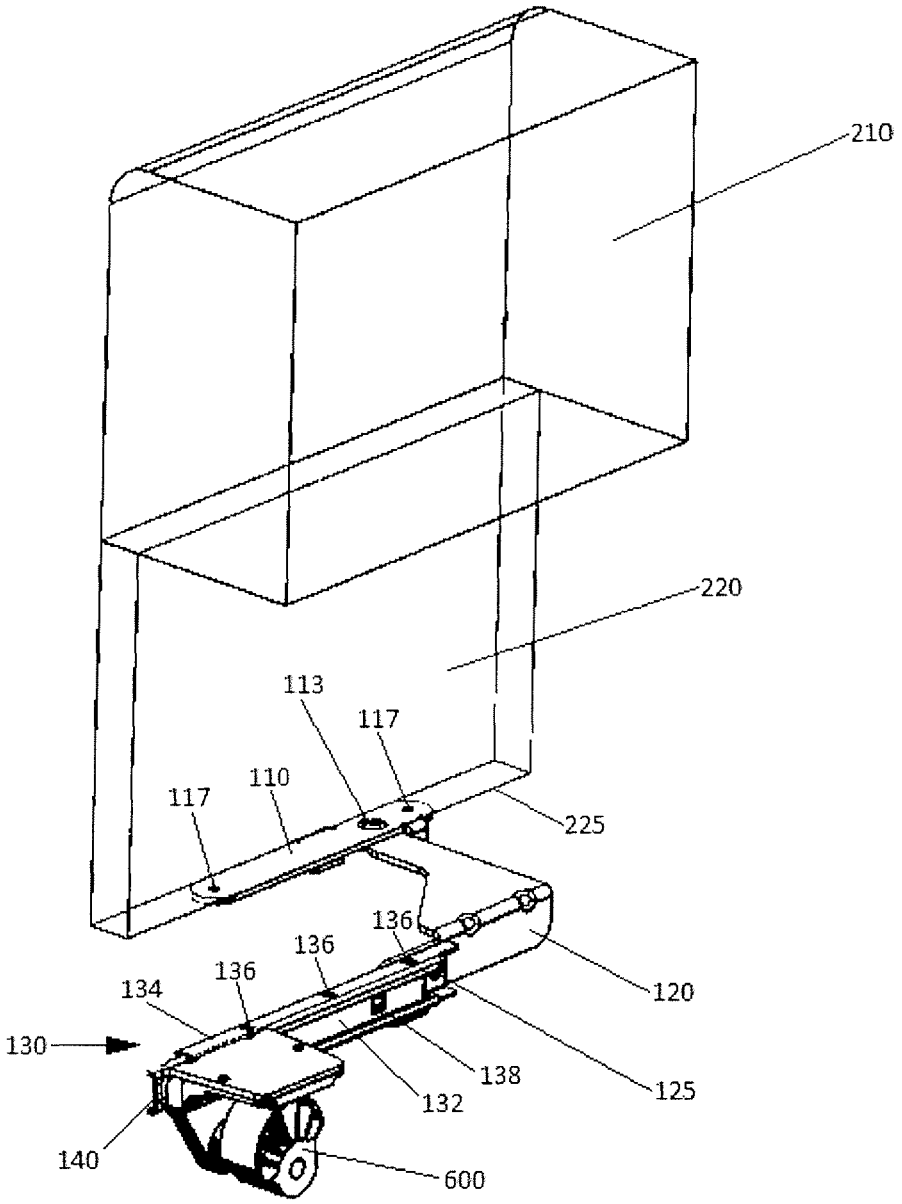
FIG. 2 is a view of an embodiment of the adjustable-height aid of FIG. 1 in a stored position beneath a bed.

Referring to FIG. 2, the device 100 of FIG. 1 may be attached to a bottom surface 225 of a bed frame 220, so that when the first connector 120 is rotated into a stored position as shown in FIG. 2, the device 100 is not visible from above the bed frame 220 and a mattress 210 disposed on the bed frame 220 (hereinafter referred to collectively as "the bed"). In order for the device 100 to be operably attached to the bottom surface 225 of the bed frame 220, the bottom surface 225 must be elevated above the surface on which the bed frame 220 rests (e.g., the floor), preferably by more than 6 centimeters (cm), more preferably by more than 8 cm. The device 100 may be attached to the bottom surface 225 by a plurality of fasteners 117, such as nails, screws, or the like. By being attached to the bed frame 220 in the invisible, stored position, the device 100 may remain attached to the bed frame 220 when not in use without interfering with the aesthetics of the bed, for example, by not crumpling a bed skirt (not shown) attached to the mattress 210 or the bed frame 220, and without interfering with vacuuming beneath the bed, among other benefits.

Figure 3:
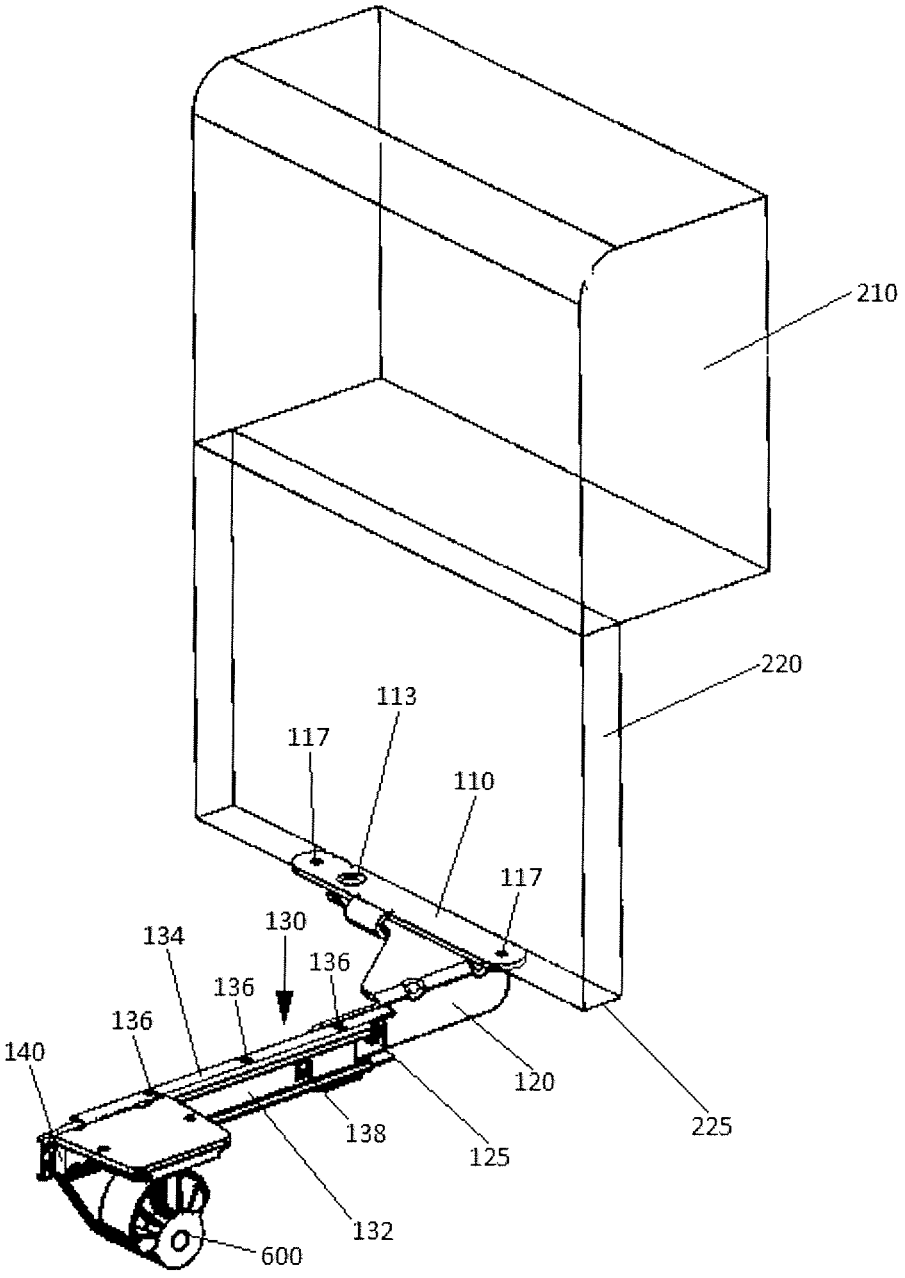
FIG. 3 is a view of an embodiment of the adjustable-height aid of FIG. 1 in an unextended ready position, rotated out from beneath the bed.

Referring to FIG. 3, the device 100 may be moved from the stored position of FIG. 2 to a ready position as shown in FIG. 3 by rotating the first connector 120 about the first rotating element 113 so that the second rotating element 125 is no longer underneath the bed frame 220 and the telescoping shaft 130 is approximately perpendicular to the length of the bed frame 220.

Figure 4A:
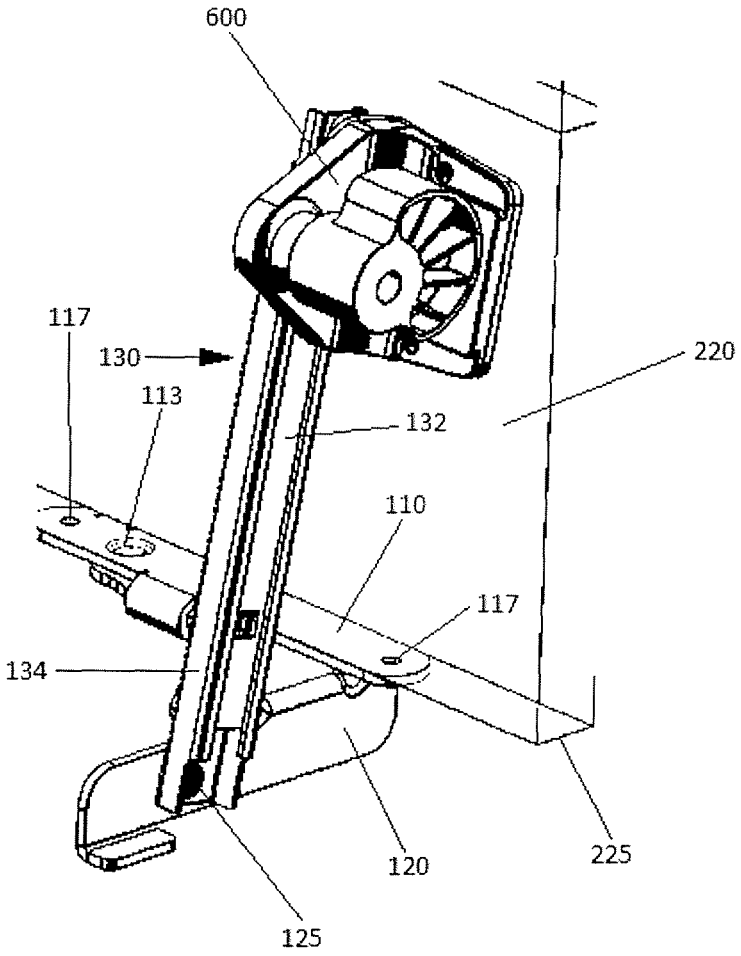
FIG. 4A is a view of an embodiment of the adjustable-height aid of FIG. 1 in an unextended first use position, rotated out from beneath the bed.
Figure 4B:
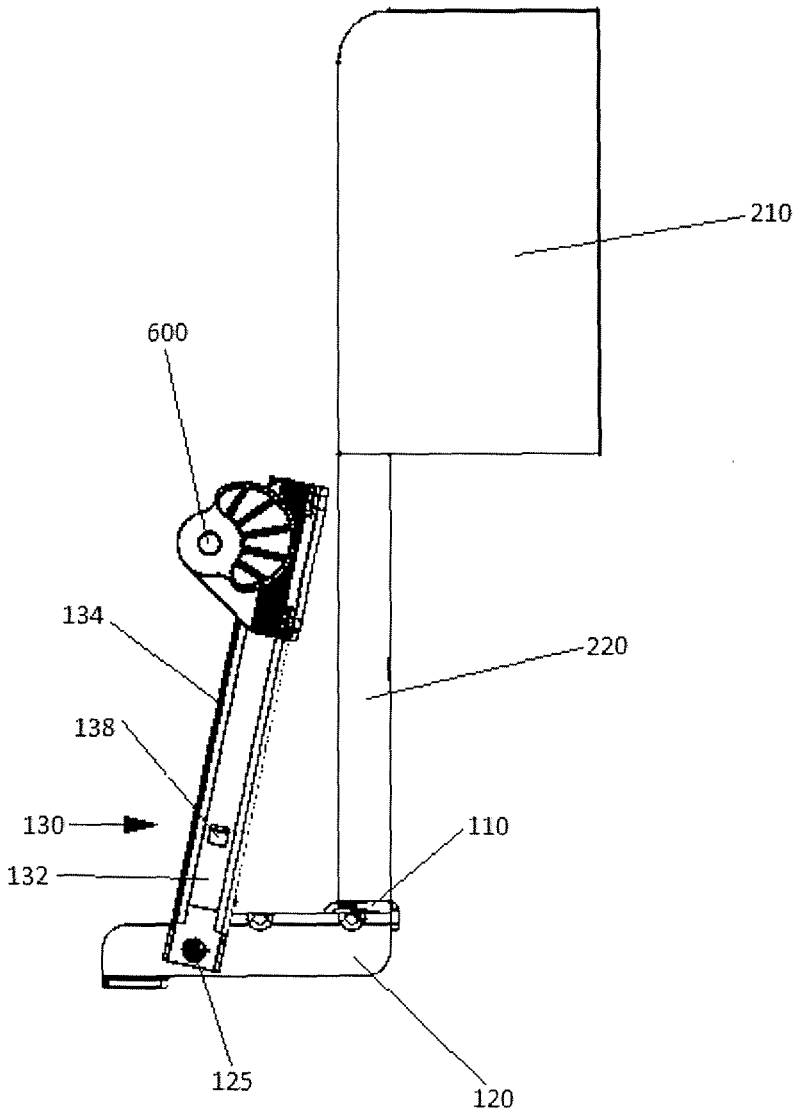
FIG. 4B is a view of an embodiment of the adjustable-height aid of FIG. 1 in the unextended first use position of FIG. 4A, rotated out from beneath the bed.

Referring to FIGS. 4A and 4B, the device 100 may be moved from the ready position of FIG. 3 to an unextended first use position as shown in FIGS. 4A and 4B. The device 100 may be moved to the first use position by rotating the telescoping shaft 130 about the second rotating element 125 so that the telescoping shaft 130 takes an approximately vertical position with the gripping device 600 at the top end of the telescoping shaft 130. If the sheet or sheets can reach the gripping device 600, the device 100 may then be used in the first use position without extending the telescoping shaft 130. The method of operating the gripping device 600 is described in more detail below. Because the telescoping shaft 130 is not vertically flush against the mattress 210 or the bed frame 220, the device 100 may further not interfere with the aesthetics of the bed by not crumpling a bed skirt (not shown) attached to the mattress 210 or the bed frame 220 by leaving space for the bed skirt between the device 100 and the mattress 210 and the bed frame 220.

Figure 5A:
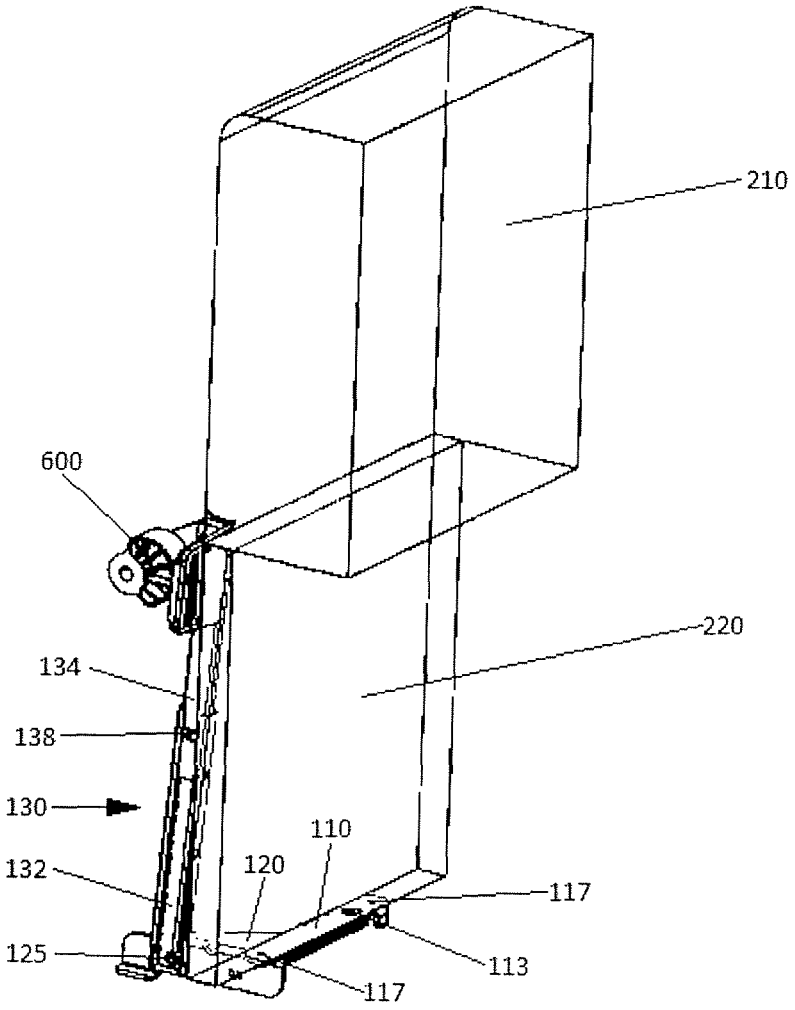
FIG. 5A is a view of an embodiment of the adjustable-height aid of FIG. 1 in an extended second use position, rotated out from beneath the bed.
Figure 5B:
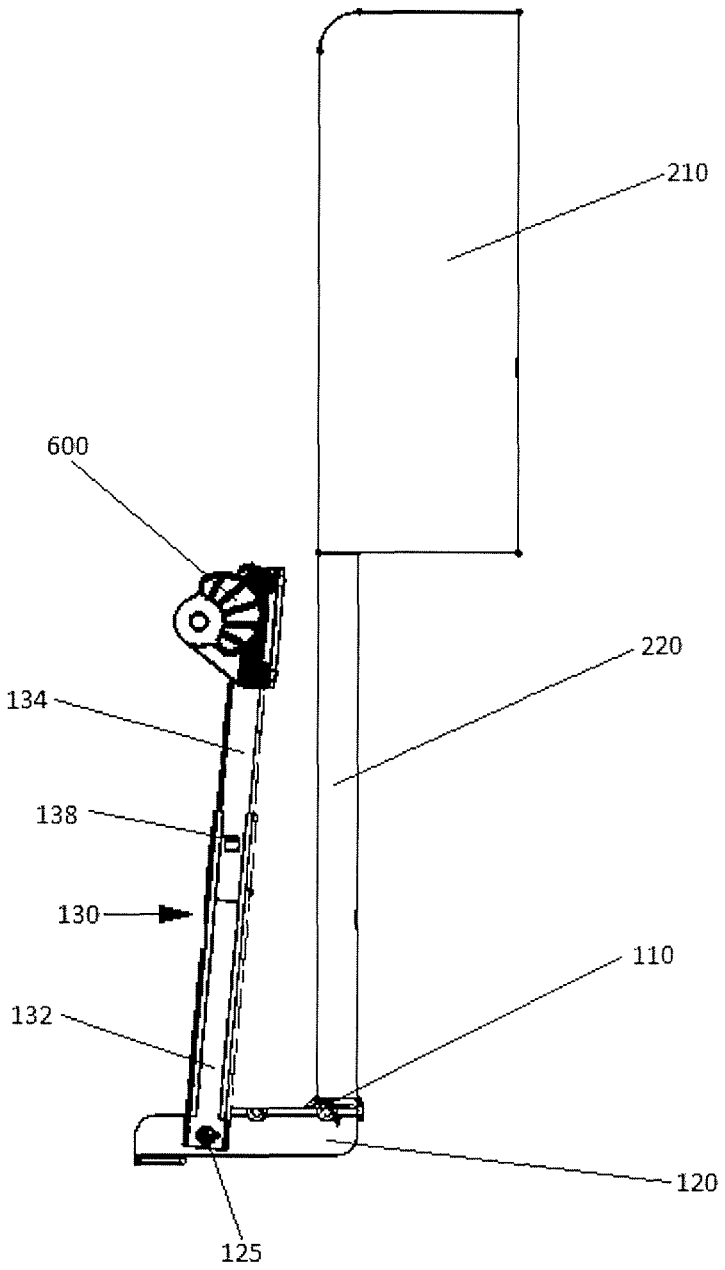
FIG. 5B is a view of an embodiment of the adjustable-height aid of FIG. 1 in the extended second use position of FIG. 5A, rotated out from beneath the bed.

Referring to FIGS. 5A and 5B, the device 100 may be moved from the first use position of FIG. 3 to an extended second use position as shown in FIGS. 5A and 5B, where the telescoping shaft 130 has a greater length in the second use position than in the first use position. The device 100 may be used in the extended second use position in situations where the sheet or sheets cannot reach the gripping device 600 in the first use position. The device 100 may be moved into the second use position by sliding the inner shaft 132 upwardly relative to the outer shaft 134 until the gripping device 600 is at the desired height. The inner shaft 132 may then be locked into place by inserting the pin 136 mounted on the inner shaft 132 into one of the plurality of openings 138 located along the length of the outer shaft 134. Although the above description discloses only a single second use position, it will be apparent that the device 100 may include a plurality of second use positions of varying heights corresponding to the plurality of locking positions determined by the plurality of openings 138.

Figure 6A:
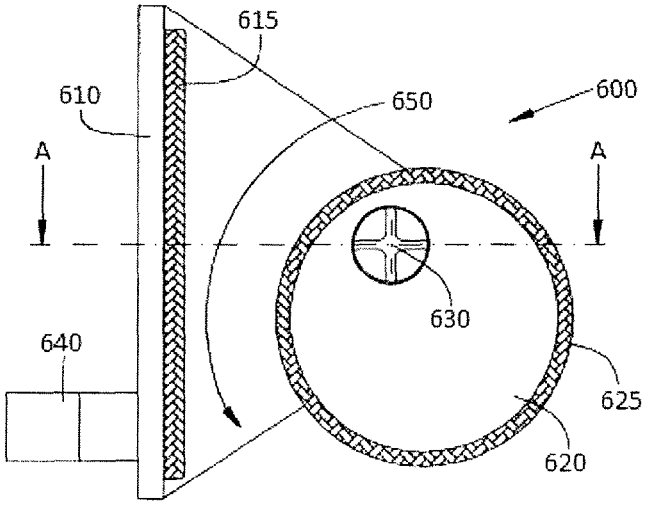
FIG. 6A is a side view of the base and the movable element of the preferred embodiment of the adjustable-height aid of FIG. 1.
Figure 6B:
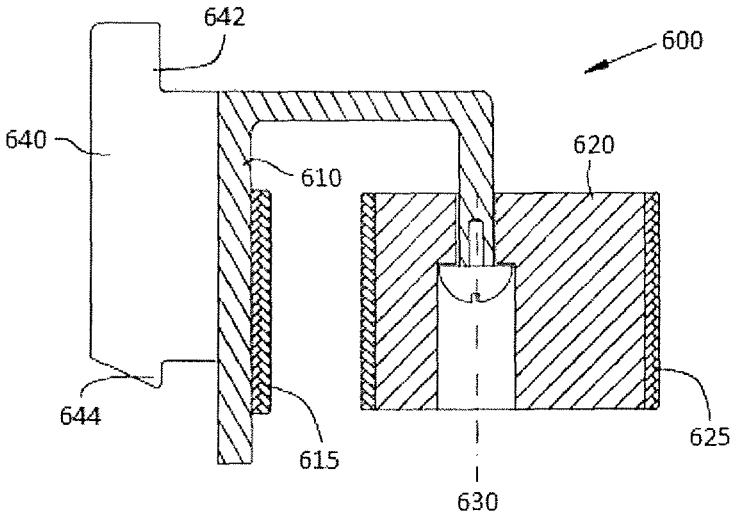
FIG. 6B is a cross-sectional view of the base and the movable element of FIG. 6A along line A-A of FIG. 6A.

Referring to FIGS. 6A and 6B, the gripping element 600 may include a base 610 having a first gripping surface 615 and a movable element 620 having a second gripping surface 625. FIG. 6B is a cross-sectional view of FIG. 6A taken along the line A-A of FIG. 6A. In some embodiments, the first gripping surface 615 may be flat. The movable element 620 may be rotatable with respect to the base 610 around a rotational axis 630 parallel to the first gripping surface 615. The rotational axis 630 may be a shaft attached to the base 610 and the movable element 620 may be attached to the shaft, for example by screws, clips, or the like. The movable element 620 may rotate between a free position in which the first gripping surface 615 is spaced apart from the second gripping surface 625, and a gripping position in which the first gripping surface 615 is in direct or indirect (e.g., with a sheet inserted between) contact with the second gripping surface 625. The position of the center of gravity of the movable element 620 is such that, under its own weight, the movable element 620 remains in the free position. For example, the movable element 620 may be a cylinder having a center axis offset from the rotational axis 630.

In the free position, the dimensions of the moveable element 620 are such that the distance between the first gripping surface 615 and the second gripping surface 625 allows for the insertion of one or more sheets. When the sheet or sheets are introduced between the first gripping surface 615 and the second gripping surface 625, the moveable element 620 may not reach the gripping position because of the thickness of the one or more sheets, but will reach an intermediate position wherein the second gripping surface 625 clamps the one or more sheets against the first gripping surface 615. To aid the first gripping surface 615 and the second gripping surface 625 in clamping the one or more sheets, one or both of the first gripping surface 615 and the second gripping surface 625 may be covered with a non-slip material.

Figure 7A:
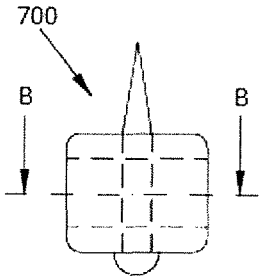
FIG. 7A is a side view of a shoe capable of securing a foot of the base of FIGS. 6A and 6B.
Figure 7B:
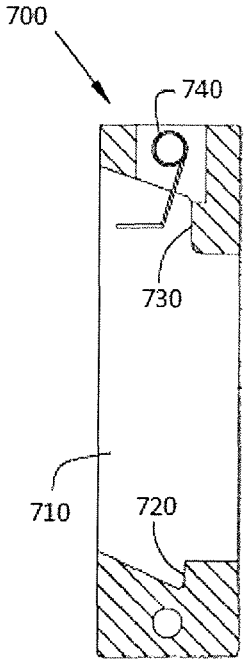
FIG. 7B is a cross-sectional view of the shoe of FIG. 7A along line B-B of FIG. 7A.

Referring to FIGS. 7A and 7B, in an alternative embodiment, the second connector 140 may include a shoe 700 sized to allow for insertion of a foot 640 (FIGS. 6A and 6B) having a top protrusion 642 (FIG. 6B) and a bottom protrusion 644 (FIG. 6B). FIG. 7B is a cross-sectional view of FIG. 7A taken along line B-B of FIG. 7A. The shoe 700 has a groove 710, where a top stop 730 and a bottom stop 720 create an opening to the groove 710 having a smaller cross-sectional area than the internal cavity of the groove 710. The groove 710 is sized to hold the foot 640. To allow for insertion of the foot 640 into the groove 710, the dimensions of the foot 640, the top protrusion 642, the bottom protrusion 644, the groove 710, the top stop 730, and the bottom stop 720 are such that when the foot 640 is in the groove 710, it is displaceable in a shifting direction perpendicular (towards the top of FIG. 7B) to the direction of introduction of the foot 640 in the groove 710 (i.e., past the top protrusion 642 and the bottom protrusion 644) and which allows the user to move the foot 640 between the top stop 730 and the bottom stop 720. Once inserted into the shoe 700, the foot 640 is held in place by a spring 740, for example, a torsion spring secured in the shoe 700 by a screw threading.

The device 100 described above in conjunction with the figures may be used, for example, by a user of the device 100, such as a housekeeper, to cover a comforter with a duvet cover. A pair of the devices 100, attached to the bed frame 220 on opposite sides of the bed, may be used. Therefore, embodiments of the present invention may further include kits including two of the devices 100.

The user may first rotate the first connector 120 relative to the bracket 110 to move the device 100 from its stored position (FIG. 2) to its ready position (FIG. 3). The user may then rotate the telescoping shaft 130 to a substantially vertical position relative to the first connector 120 to move the device 100 from its stored position (FIG. 3) to its first use position (FIGS. 4A and 4B). If the duvet cover does not have sufficient length to reach the gripping device 600 in the first use position, the user may then extend the telescoping shaft 130 to the second use position (FIGS. 5A and 5B), where the telescoping shaft 130 has a length allowing the duvet cover to reach the gripping device 600. The user may then take one corner of the comforter and insert it into the duvet cover, aligning the comforter inside a first corner of the duvet cover. The user may then introduce the first corner of the duvet cover between the first gripping surface 615 and the second gripping surface 625 of the first device 100 near the first corner of the comforter, in the direction 650 indicated in FIG. 6A. The user may then pull on the inserted first corner in the direction opposite the direction 650, causing the movable element 620 to rotate toward the base 610 and pinch the first corner between the first gripping surface 615 and the second gripping surface 625 of the first device 100. The user may then repeat the process for a second corner of the duvet cover and the second device 100, so that the first corner and the second corner of the duvet cover are held in place by the pair of devices 100 while the user can easily pull on the other corners of the duvet cover.

After the user is finished inserting the comforter into the duvet cover, the user may remove the corners of the duvet cover from the devices 100, and return the devices 100 to their stored position by collapsing the telescoping shafts 130, rotating the telescoping shafts 130 back to their ready position, and rotating the first connector 120 so that the telescoping shafts 130 return to the stored position beneath the bed.

Although illustrated and described above with reference to certain specific embodiments and examples, the present invention is nevertheless not intended to be limited to the details shown. Rather, various modifications may be made in the details within the scope and range of equivalents of the claims and without departing from the spirit of the invention. It is expressly intended, for example, that all ranges broadly recited in this document include within their scope all narrower ranges which fall within the broader ranges.

What is claimed is:

1. An adjustable-height device to aid the stretching of a sheet on a bed having a bed frame, the device comprising:

a bracket for attaching the adjustable-height device to a bottom surface of the bed frame;

a first connector attached to the bracket by a first rotating element, wherein the first connector is rotatable about the first rotating element with respect to the bracket;

a telescoping shaft attached to the first connector by a second rotating element, wherein the telescoping shaft is rotatable about the second rotating element with respect to the first connector, wherein the telescoping shaft includes an inner shaft slidably inserted into an outer shaft; and a gripping device attached to the telescoping shaft by a second connector including a shoe sized to allow for insertion of a foot attached to the gripping device, where the foot and the shoe may be detached after insertion, wherein the gripping device includes:

a base having a first gripping surface, and a movable element having a second gripping surface rotatable about a rotational axis with respect to the base between:

a free position in which the first gripping surface is spaced apart from the second gripping surface, and a gripping position in which the first gripping surface is in direct or indirect contact with the second gripping surface, wherein the movable element is a rotationally symmetrical cylinder having a center axis offset from the rotational axis.

2. The adjustable height device of claim 1, wherein the first connector is adapted to be rotated about the first rotating element so that the adjustable height device is in a stored position entirely beneath the bed frame.

3. The adjustable height device of claim 1, wherein the first connector is adapted to be rotated about the first rotating element so that the adjustable height device is in a ready position where the second rotating element and the telescoping shaft are not beneath the bed frame.

4. The adjustable height device of claim 1, wherein the telescoping shaft is adapted to be rotated about the second rotating element, so that the device is in a first use position where the gripping element is at a first height above the bottom surface of the bed frame and the telescoping shaft is unextended.

5. The adjustable height device of claim 4, wherein the telescoping shaft is adapted to be extended by sliding the inner shaft upwardly with respect to the outer shaft, so that the device is in a second use position where the gripping element is at a second height above the bottom surface of the bed frame greater than the first height.

6. The adjustable-height device of claim 5, wherein the telescoping shaft further comprises a spring-loaded pin attached to the inner shaft and a plurality of openings in the outer shaft, wherein the spring-loaded pin fits in the plurality of openings of the outer shaft to lock the telescoping shaft in one of the first use position or the second use position.

7. The adjustable-height device of claim 5, wherein the device is adapted to be put in a plurality of second use positions corresponding to the plurality of openings in the outer shaft.

8. The adjustable-height device of claim 1, wherein the first rotating element comprises a rivet.

9. The adjustable-height device of claim 1, wherein the second rotating element comprises a rivet.

10. The adjustable height device of claim 1, wherein the bracket comprises a stop to prevent the first connector from rotating beyond a predetermined limit.

11. An adjustable-height device to aid the stretching of a sheet on a bed having a bed frame, the device comprising:

a bracket for attaching the adjustable-height device to a bottom surface of the bed frame;

a first connector attached to the bracket by a first rotating element, wherein the first connector is rotatable about the first rotating element with respect to the bracket;

a telescoping shaft attached to the first connector by a second rotating element, wherein the telescoping shaft is rotatable about the second rotating element with respect to the first connector, wherein the telescoping shaft includes an inner shaft slidably inserted into an outer shaft; and a gripping device attached to the telescoping shaft by a second connector including a fastener irremovably connecting the gripping device to the telescoping shaft, wherein the gripping device includes:

a base having a first gripping surface, and a movable element having a second gripping surface rotatable about a rotational axis with respect to the base between:

a free position in which the first gripping surface is spaced apart from the second gripping surface, and a gripping position in which the first gripping surface is in direct or indirect contact with the second gripping surface, wherein the movable element is a rotationally symmetrical cylinder having a center axis offset from the rotational axis.

12. The adjustable height device of claim 11, wherein the first connector is adapted to be rotated about the first rotating element so that the adjustable height device is in a stored position entirely beneath the bed frame.

13. The adjustable height device of claim 11, wherein the first connector is adapted to be rotated about the first rotating element so that the adjustable height device is in a ready position where the second rotating element and the telescoping shaft are not beneath the bed frame.

14. The adjustable height device of claim 11, wherein the telescoping shaft is adapted to be rotated about the second rotating element, so that the device is in a first use position where the gripping element is at a first height above the bottom surface of the bed frame and the telescoping shaft is unextended.

15. The adjustable height device of claim 14, wherein the telescoping shaft is adapted to be extended by sliding the inner shaft upwardly with respect to the outer shaft, so that the device is in a second use position where the gripping element is at a second height above the bottom surface of the bed frame greater than the first height.

16. The adjustable-height device of claim 15, wherein the telescoping shaft further comprises a spring-loaded pin attached to the inner shaft and a plurality of openings in the outer shaft, wherein the spring-loaded pin fits in the plurality of openings of the outer shaft to lock the telescoping shaft in one of the first use position or the second use position.

17. The adjustable-height device of claim 15, wherein the device is adapted to be put in a plurality of second use positions corresponding to the plurality of openings in the outer shaft.

18. The adjustable-height device of claim 11, wherein the first rotating element comprises a rivet.

19. The adjustable-height device of claim 11, wherein the second rotating element comprises a rivet.

20. The adjustable height device of claim 11, wherein the bracket comprises a stop to prevent the first connector from rotating beyond a predetermined limit.

* * * * *